US010144627B2

(12) United States Patent
D'Errico et al.

(10) Patent No.: US 10,144,627 B2
(45) Date of Patent: Dec. 4, 2018

(54) MACHINE AND METHOD FOR FILLING CONTAINERS WITH POURABLE PRODUCT

(71) Applicant: Sidel S.p.A. CON SOCIO UNICO, Parma (IT)

(72) Inventors: Stefano D'Errico, Parma (IT); Enrico Cocchi, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 43 days.

(21) Appl. No.: 15/116,876

(22) PCT Filed: Feb. 19, 2015

(86) PCT No.: PCT/IB2015/051280
§ 371 (c)(1),
(2) Date: Aug. 5, 2016

(87) PCT Pub. No.: WO2015/125108
PCT Pub. Date: Aug. 27, 2015

(65) Prior Publication Data
US 2017/0166429 A1 Jun. 15, 2017

(30) Foreign Application Priority Data
Feb. 19, 2014 (EP) ..... 14155855

(51) Int. Cl.
*B67C 3/20* (2006.01)
*B67C 3/04* (2006.01)
(Continued)

(52) U.S. Cl.
CPC ..... *B67C 3/204* (2013.01); *B67C 3/04* (2013.01); *B67C 3/225* (2013.01); *B67C 3/24* (2013.01); *B67C 3/28* (2013.01)

(58) Field of Classification Search
CPC .. B67C 3/02; B67C 3/004; B67C 3/04; B67C 3/24; B67C 3/28; B67C 3/204; B67C 3/225; B67C 2003/2694; B67C 2003/228
(Continued)

(56) References Cited

U.S. PATENT DOCUMENTS 6,192,946 B1 * 2/2001 Clusserath ..... B67C 3/12 141/40

FOREIGN PATENT DOCUMENTS

| | | |
|---|---|---|
| DE | 29609831 | 7/1997 |
| FR | 2852944 | 10/2004 |
| WO | WO 2006/075239 A1 | 7/2006 |

OTHER PUBLICATIONS

International Search Report and Written Opinion dated May 7, 2015 in corresponding PCT International Application.

* cited by examiner

*Primary Examiner* — Timothy L Maust
(74) *Attorney, Agent, or Firm* — Finnegan, Henderson, Farabow, Garrett & Dunner LLP

(57) ABSTRACT

A filling machine for filling containers with a pourable product, comprising: a product tank containing the pourable product and a first gas maintained at a first pressure value; at least one dosing tank containing a second gas; a first pressurizing device configured to selectively pressurize the second gas in the at least one dosing tank to a second pressure value, that is lower than the first pressure value; a controller configured to: set the second valve in an open configuration after the at least one dosing tank has been pressurized to the second pressure value; and set the second valve in the closed configuration as the pressure detected by the sensor in the at least one dosing tank reaches a third
(Continued)

pressure value corresponding to a predetermined volume of the pourable product in the dosing tank.

11 Claims, 4 Drawing Sheets

(51) Int. Cl.
*B67C 3/22* (2006.01)
*B67C 3/24* (2006.01)
*B67C 3/28* (2006.01)

(58) Field of Classification Search
USPC ..... 141/89–93
See application file for complete search history.

MACHINE AND METHOD FOR FILLING CONTAINERS WITH POURABLE PRODUCT

CROSS-REFERENCE TO RELATED APPLICATION

This application is a National Stage Entry of International Application No. PCT/IB2015/051280, filed Feb. 19, 2015, which claims priority from European Patent Application No. 14155855.1, filed Feb. 19, 2014. The entire contents of the above-referenced applications are expressly incorporated herein by reference.

TECHNICAL FIELD

The present invention relates to a machine and a method for filling containers with a pourable product.

The present invention may be used to particular advantage for liquid products with particles, i.e. liquid products containing particles, such as soft drinks or beverages with fruit particles, which the following description will refer to, although this is in no way intended to limit the scope of protection as defined by the accompanying claims.

BACKGROUND ART

As known, there is an increasing demand from the market for soft drinks or beverages containing fruit particles or pieces, such as soft fruit bits, normally available in cubes or slices, fruit fibers, containing large portions of fruit cellulose, and fruit sacs, i.e. intact "pouch-like" structures of a citrus fruit, containing fruit juice and having lengths up to 5-8 mm.

A typical known filling machine used for this kind of pourable products substantially comprises a carousel rotating about an axis, a product tank containing the pourable product, and a plurality of filling units supported by the carousel in positions radially external with respect to the carousel axis and conveyed by the carousel along a circular transfer path.

In particular, the carousel receives a succession of empty containers from an input star wheel and releases the filled containers to an output star wheel.

Each filling unit comprises a dosing tank to measure out a given volume of pourable product to be then fed to the respective container, a fluidic line connecting the dosing tank to the product tank, and a support element provided to arrange the mouth of the respective container in a lower position than the dosing tank.

Movable plungers are typically used to convey the pourable product from the product tank to each dosing tank and to measure up the volume of pourable product within each dosing tank; in particular, by detecting the displacement of the respective movable plunger during filling of each dosing tank, it is possible to determine the volume of pourable product flowed into the dosing tank itself.

Interaction of moving parts with this kind of pourable products may cause damage of the fruit particles, in particular when these particles are sacs.

DISCLOSURE OF INVENTION

It is therefore an object of the present invention to provide a machine for filling containers with a pourable product, which is designed to overcome the aforementioned drawback, and which is capable of performing a gentle action on the pourable product during conveyance thereof from the product tank to the dosing tank and from the latter to the final container.

According to the present invention, there is provided a machine for filling containers with a pourable product, as claimed in claim 1.

The present invention also relates to a method for filling containers with a pourable product, as claimed in claim 8.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
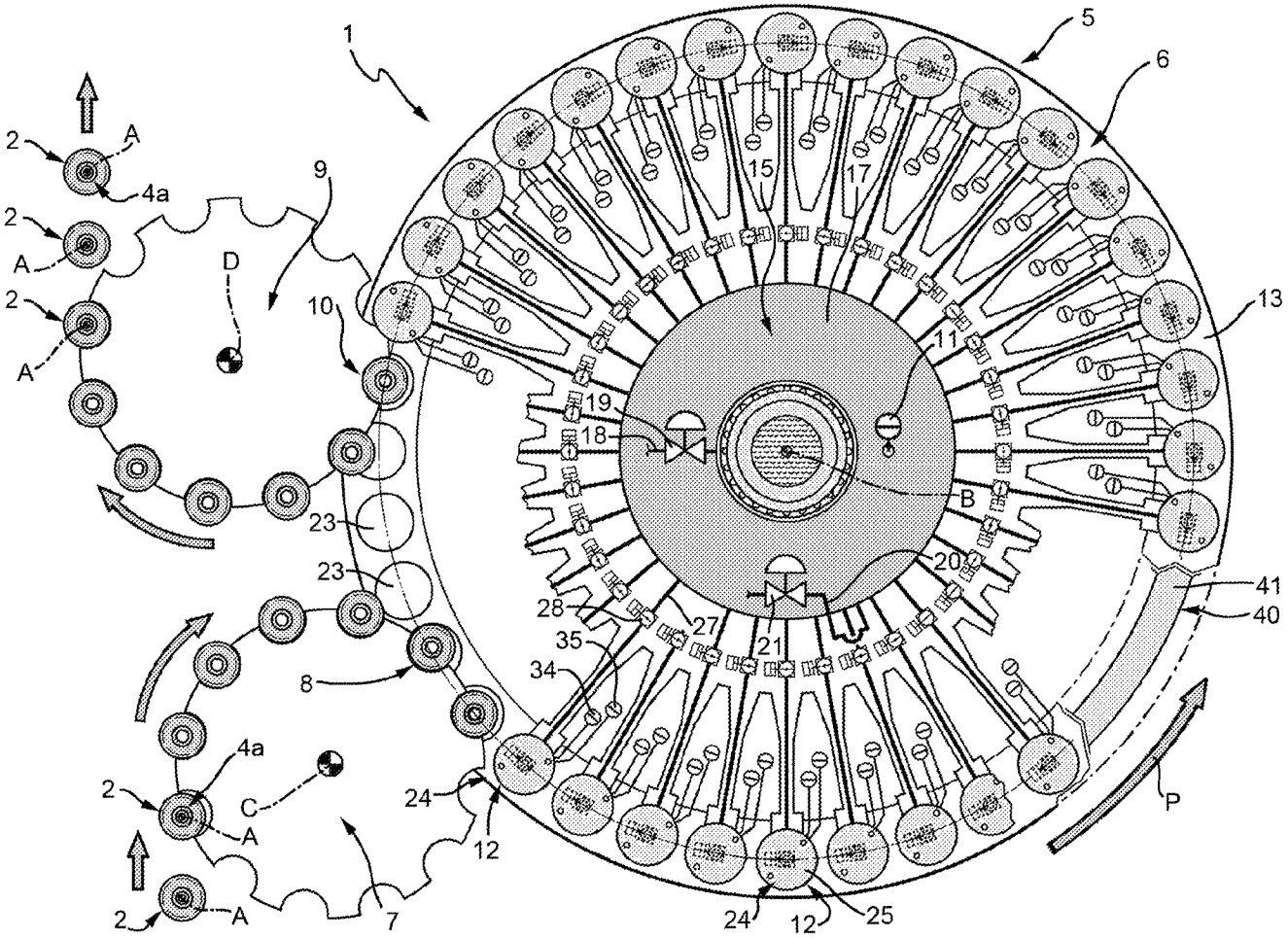
FIG. 1 shows a schematic top plan view, with parts removed for clarity, of a filling machine according to the present invention.

Number 1 in FIG. 1 indicates as a whole a filling machine to fill containers, in particular bottles 2, with pourable products, in the example shown liquid products with particles, i.e. solid parts immersed in the liquid; typical examples of these pourable products are soft drinks or beverages containing fruit particles, such as soft fruit bits, fruit fibers and fruit sacs.

Machine 1 is clearly also adapted to fill bottles 2 with other types of pourable products, either food products, such as milk, still water, carbonated water, fruit juices, beer, soft drinks and beverages in general, or non-food products, such as detergents. Machine 1 is also adapted to fill bottles 2 with emulsions, suspensions and high viscosity liquids.

As visible in particular in FIGS. 2 to 6, each bottle 2 has a longitudinal axis A and comprises:

- a bottom wall 3 substantially perpendicular to axis A;
- a mouth 4*a*, opposite to bottom wall 3, to allow the filling of the bottle 2 by machine 1 and the following pouring of the pourable product from the bottle 2 itself; and
- a neck 4*b* arranged immediately below mouth 4*a*.

In the example shown, bottles 2 are made of plastics; however, machine 1 may be also used for other types of containers, such as containers made of aluminum, steel, glass and composites.

Machine 1 comprises a conveying device 5 (FIG. 1) that serves to fill the bottles 2 while they are conveyed along a transfer path P.

In the preferred embodiment as illustrated in FIG. 1, conveying device 5 comprises a carousel 6, which is mounted to rotate continuously (anticlockwise in FIG. 1) about a vertical axis B perpendicular to the FIG. 1 plane.

Carousel 6 receives a succession of empty bottles 2 from an input star wheel 7, which cooperates with the carousel 6 itself at a first transfer station 8 and is mounted to rotate continuously about a respective longitudinal axis C parallel to axis B.

Carousel 6 releases a succession of filled bottles 2 to an output star wheel 9, which cooperates with the carousel 6 itself at a second transfer station 10 and is mounted to rotate continuously about a respective longitudinal axis D parallel to axes B and C.

Machine 1 further comprises a plurality of filling units 12 for filling respective bottles 2 while they are advanced by carousel 6. Filling units 12 are equally spaced angularly about axis B, are mounted along a peripheral portion 13 of carousel 6, and are moved by the carousel 6 along path P; in the present case, path P has a circular configuration about axis B and extends through stations 8 and 10.

Machine 1 also includes a product tank 15 common to all filling units 12 and which comprises (FIGS. 2 to 6) a lower portion 16, filled with the pourable product, and an upper portion 17 filled with a gas.

In particular, the gas is a pressurization gas, in the present case sterile air, adapted to pressurize the inside of product tank 15 at a pressure value $P_1$, preferably higher than the environment pressure.

The gas flows into upper portion 17 of product tank through a fluidic line 18 and a valve 19 arranged along the fluidic line 18.

In particular, valve 19 is selectively set in:

an open configuration, in which it allows the gas to flow into product tank 15 through fluidic line 18; and a closed configuration, in which it prevents the gas from flowing into product tank 15.

The gas is discharged from product tank 15 through a fluidic line 20 and a valve 21 arranged along the fluidic line 20.

Even in this case, valve 21 is selectively set in:

an open configuration, in which it allows the gas to flow out of product tank 15 through fluidic line 20; and a closed configuration, in which it prevents the gas from flowing out of product tank 15.

Pressure inside product tank 15 is continuously detected by a pressure sensor 11.

Valves 19 and 21 are controlled by a control unit on the basis of the pressure detected by pressure sensor 11 so as to maintain the inside of product tank 15 at pressure value $P_1$.

As shown in the enclosed Figures, each filling unit 12 comprises a support device 23, adapted to receive and retain a relative bottle 2 in a vertical position, in which such bottle 2 has its axis A parallel to axis B of carousel 6, and a filling device 24 for feeding the pourable product into a bottle 2 as the support device 23 travels along path P.

Each filling device 24 is conveniently arranged above the bottle 2 to be filled.

With reference to FIGS. 2 to 6, each filling device 24 comprises a dosing tank 25 to measure out a given volume V of pourable product to be fed to the respective bottle 2 through a valve 26, and a fluidic line 27 connecting bottom portion 16 of product tank 15 to the dosing tank 25 through a valve 28, arranged along the fluidic line 27.

Each dosing tank 25 is defined by a rigid container or chamber, arranged above the bottle 2 to be filled with the measured volume V of pourable product.

In particular, each dosing tank 25 contains a gas, in the present case sterile air, which is pressurized as a result of the filling of the dosing tank 25 with the pourable product.

Each dosing tank 25 has a main cylindrical portion and a bottom neck defining an outlet mouth 31, through which the pourable product is fed to the respective bottle 2 under the control of respective valve 26.

Each valve 26 is arranged along outlet mouth 31 of the respective dosing tank 25 and is selectively set in:

an open configuration (FIG. 6), in which it allows the pourable product contained in the respective dosing tank 25 to flow into the respective bottle 2; and a closed configuration (FIGS. 3 to 5), in which it prevents the pourable product from flowing out from the respective dosing tank 25 towards the bottle 2 beneath.

In a completely analogous manner, each valve 28 is selectively set in:

an open configuration (FIG. 5), in which it allows the pourable product contained in product tank 15 to flow into the respective dosing tank 25; and a closed configuration (FIGS. 3, 4 and 6), in which it prevents the pourable product from flowing out from product tank 15.

Each fluidic line 27 extends between a bottom wall of product tank 15 to a lateral wall 33 of main portion 30 of the respective dosing tank 25.

As shown in FIGS. 2 to 6, each filling device 24 further comprises a pressure sensor 34, to detect pressure in the respective dosing tank 25, and a temperature sensor 35 to detect temperature in said dosing tank 25. The functions of sensors 34, 35 will be clarified later on.

Machine 1 further comprises first pressurizing means 40 selectively pressurizing each dosing tank 25 at a pressure value $P_2$, lower than first pressure value $P_1$, in a condition in which the respective valves 26 and 28 are both in their closed configurations and the dosing tank 25 is product-free, i.e. only contains gas.

Pressure value $P_2$ is preferably higher than the environment pressure.

Pressurization of each dosing tank 25 is performed prior to starting filling thereof with the pourable product contained in product tank 15, so as to allow flow of the pourable product to the dosing tank 25 under the difference between pressure values $P_1$ and $P_2$ only, with limited use of movable parts or pumps acting on the pourable product.

First pressurizing means 40 basically comprise a first pressurizing tank 41, which is filled with gas, in the present case sterile air, maintained at pressure value $P_2$, and is fluidically connected to each dosing tank 25 through a respective fluidic line 42 and a respective valve 43, arranged along the fluidic line 42.

In particular, first pressurizing tank 41 has an annular configuration about axis B and is common to all filling units 12. First pressurizing tank 41 is carried by carousel 6 and is arranged above dosing tanks 25.

Each valve 43 is selectively set in:

an open configuration (FIG. 4), in which it allows the gas to flow from first pressurizing tank 41 to the respective dosing tank 25 through fluidic line 42; and a closed configuration (FIGS. 3, 5 and 6), in which it prevents the gas from flowing into the dosing tank 25.

Figure 2:
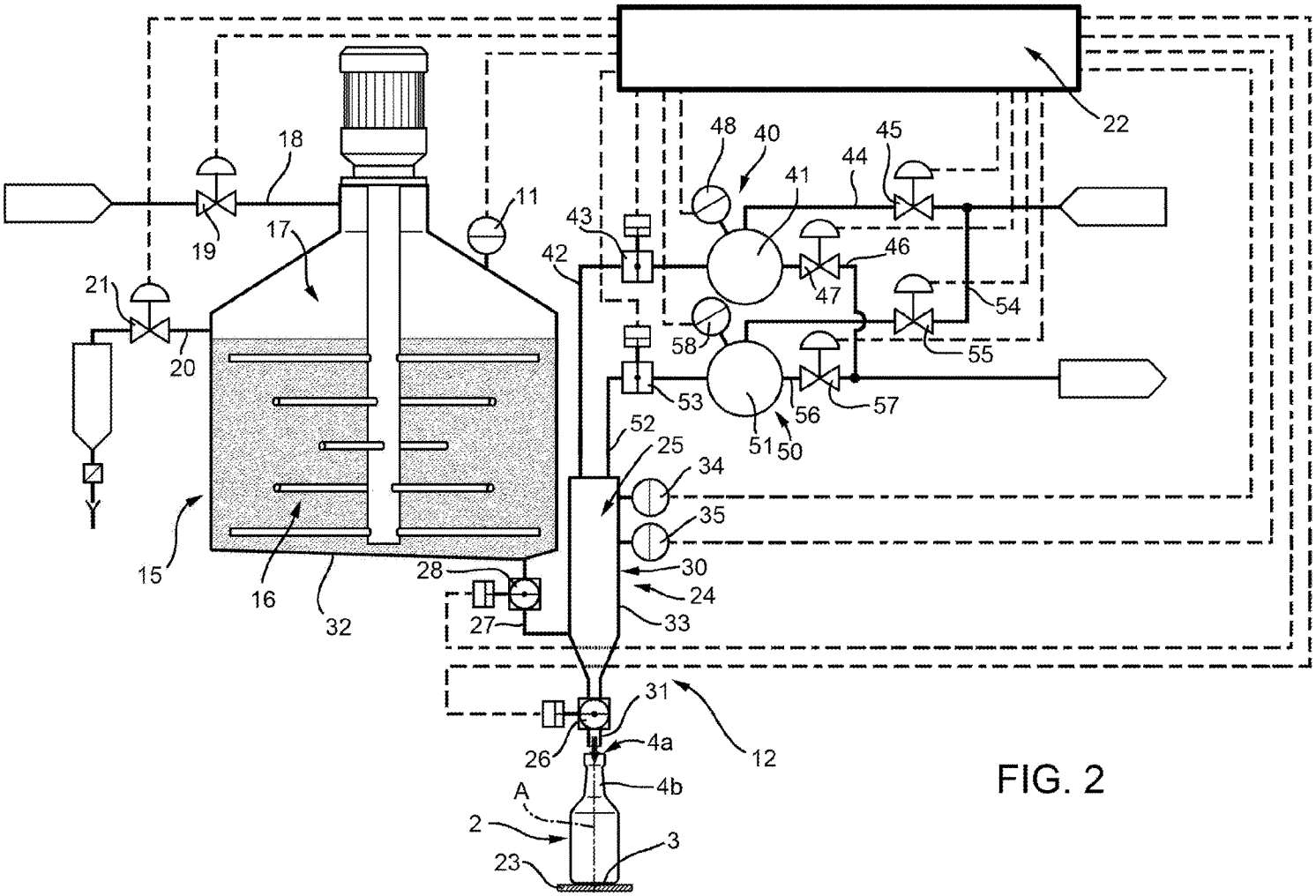
FIG. 2 shows a larger-scale, schematic front view of a filling unit of the FIG. 1 filling machine together with a product tank and other components of such machine, during a container filling operation.
Figure 4:
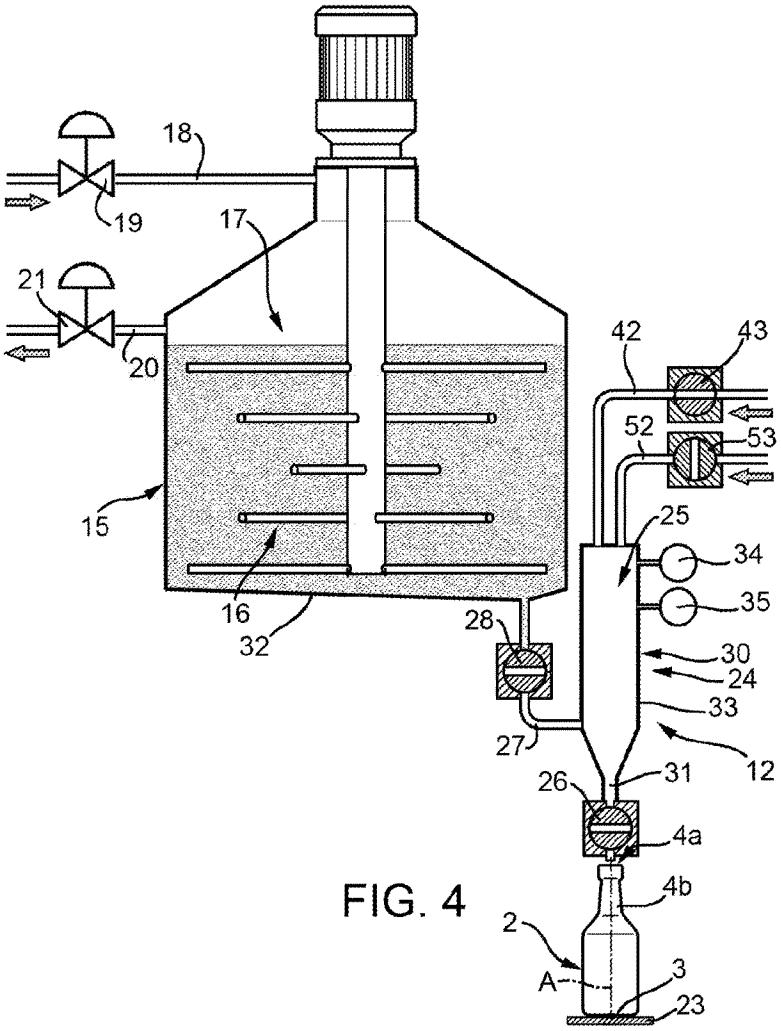
FIGS. 3 to 6 show the filling unit and the product tank of FIG. 2 during different steps of a container filling operation.
Figure 3:
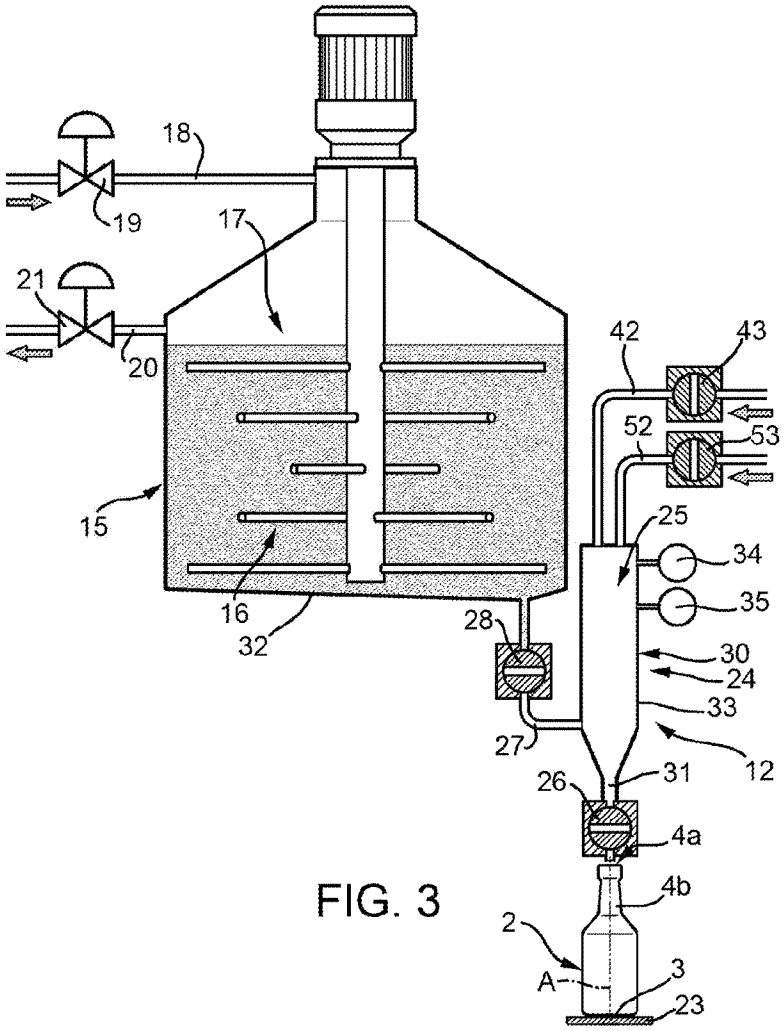
Figure 6:
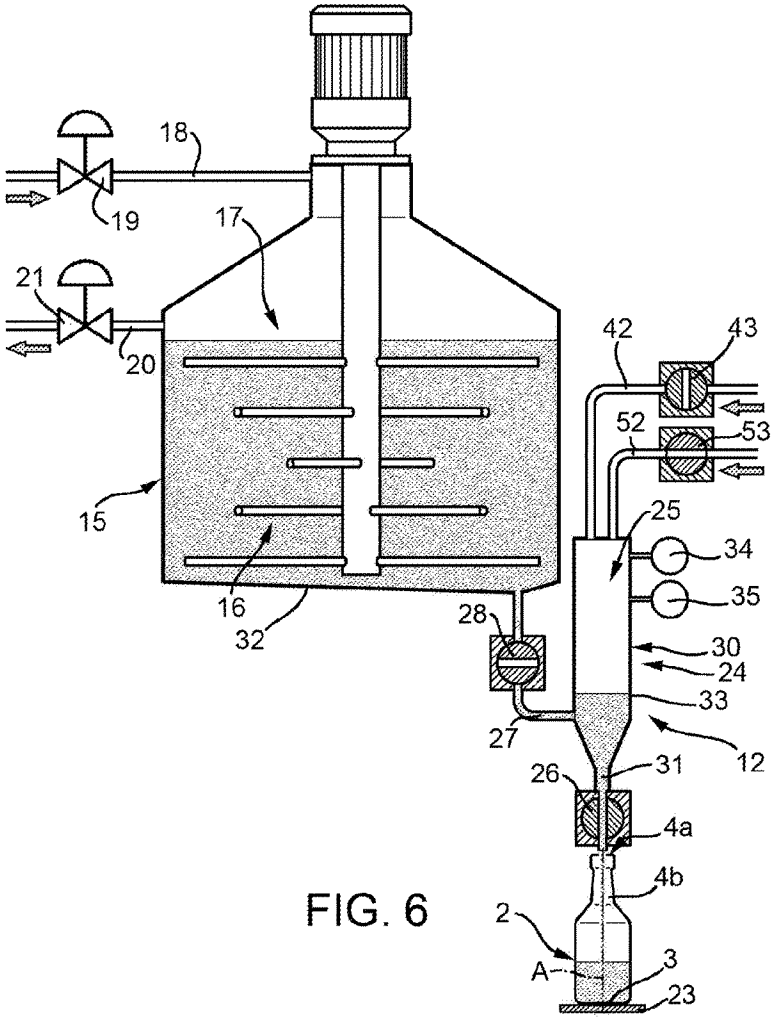
Figure 5:
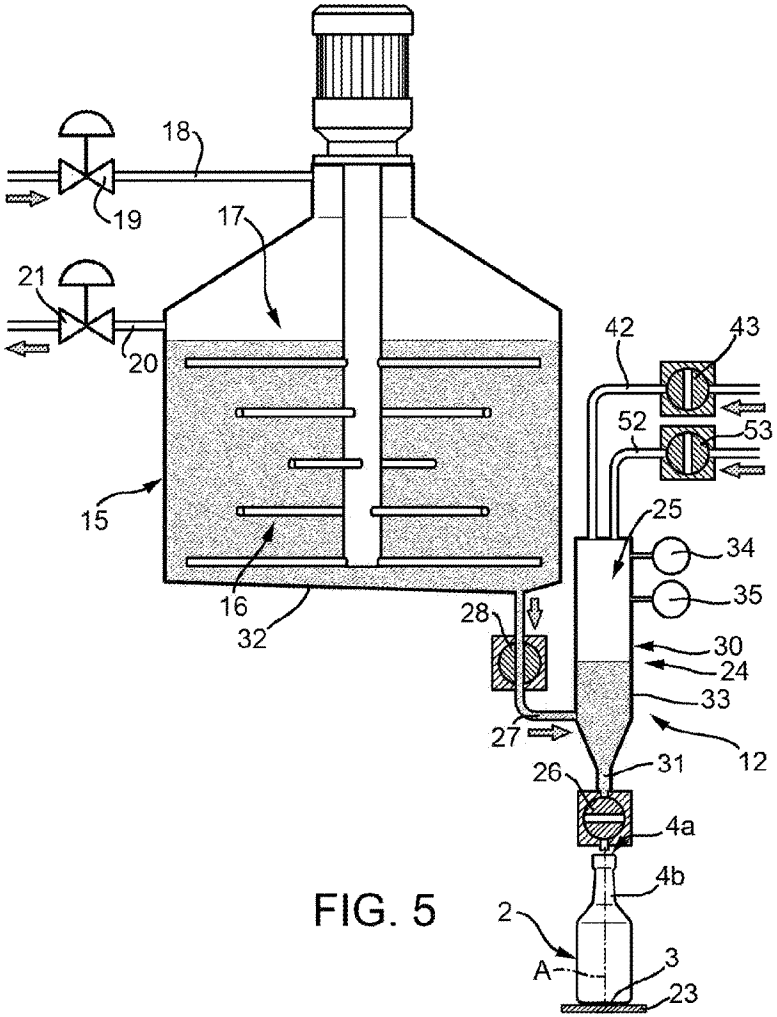

As shown in FIG. 2, the gas flows into first pressurizing tank 41 through a fluidic line 44 and a valve 45 arranged along the fluidic line 44.

In particular, valve 45 is selectively set in:

an open configuration, in which it allows the gas to flow into first pressurizing tank 41 through fluidic line 44; and a closed configuration, in which it prevents the gas from flowing into first pressurizing tank 41.

The gas is discharged from first pressurizing tank through a fluidic line 46 and a valve 47 arranged along the fluidic line 46.

Even in this case, valve 47 is selectively set in:

an open configuration, in which it allows the gas to flow out of first pressurizing tank 41 through fluidic line 46; and a closed configuration, in which it prevents the gas from flowing out of first pressurizing tank 41.

Pressure inside first pressurizing tank 41 is continuously detected by a pressure sensor 48.

Valves 45 and 47 are controlled by control unit 22 on the basis of the pressure detected by pressure sensor so as to maintain the inside of first pressurizing tank 41 at pressure value $P_2$.

Machine 1 further comprises second pressurizing means 50 selectively pressurizing each dosing tank 25 at a pressure value $P_3$, lower than pressure value $P_1$, in a condition in which the respective valve 26 is in the open configuration and the respective valve 28 is in the closed configuration.

Pressure value $P_3$ is preferably lower than pressure value $P_2$ and higher than the environment pressure.

Pressurization of each dosing tank 25 at pressure value $P_3$ is performed after filling thereof with the pourable product coming from product tank 15, so as to allow flow of the pourable product from the dosing tank 25 to the respective bottle 2 under the pressure difference therebetween only, with limited need of using movable parts or pumps acting on the pourable product Second pressurizing means 50 basically comprise a second pressurizing tank 51, which is filled with gas, in the present case sterile air, maintained at pressure value $P_3$, and is fluidically connected to each dosing tank 25 through a respective fluidic line 52 and a respective valve 53, arranged along the fluidic line 52.

In particular, second pressurizing tank 51 has an annular configuration about axis B and is common to all filling units 12. Second pressurizing tank 51 is carried by carousel 6 and is arranged above dosing tanks 25.

Each valve 53 is selectively set in:

an open configuration (FIG. 6), in which it allows the gas to flow from second pressurizing tank 51 to the respective dosing tank 25 through the respective fluidic line 52; and a closed configuration (FIGS. 3, 4 and 5), in which it prevents the gas from flowing into the dosing tank 25.

As shown in FIG. 2, the gas flows into second pressurizing tank 51 through a fluidic line 54 and a valve 55 arranged along the fluidic line 54.

In particular, valve 55 is selectively set in:

an open configuration, in which it allows the gas to flow into second pressurizing tank 51 through fluidic line 54; and a closed configuration, in which it prevents the gas from flowing into second pressurizing tank 51.

The gas is discharged from second pressurizing tank through a fluidic line 56 and a valve 57 arranged along the fluidic line 56.

Even in this case, valve 57 is selectively set in:

an open configuration, in which it allows the gas to flow out of first pressurizing tank 51 through fluidic line 56; and a closed configuration, in which it prevents the gas from flowing out of first pressurizing tank 51.

Pressure inside second pressurizing tank 51 is continuously detected by a pressure sensor 58.

Valves 55 and 57 are controlled by control unit 22 on the basis of the pressure detected by pressure sensor 58 so as to maintain the inside of second pressurizing tank 51 at pressure value $P_3$.

As shown in FIG. 2, control unit 22 is connected to all valves 19, 21, 26, 28, 43, 45, 47, 53, 55, 57 and receives signals from sensors 11, 34, 35, 48, 58.

With reference to each filling unit 12, control unit 22 is advantageously programmed:

to set the respective valve 28 in the open configuration after the respective dosing tank 25 has been pressurized at pressure value $P_2$, in order to allow the pourable product to flow from product tank 15 to said dosing tank 25 under the action of the pressure difference therebetween; and to set the valve 28 in the closed configuration as the gas pressure detected by the respective sensor 34 in the dosing tank 25, during flow of the pourable product into the dosing tank 25 itself, reaches a pressure value $P_4$ correlated with the volume V of pourable product which is desired to then convey to the respective bottle 2.

In practice, the volume V is measured up in each dosing tank 25 by considering that the product of pressure and volume of the gas present in such dosing tank 25 is substantially constant before and after filling of the dosing tank 25 itself (Boyle's gas law) if temperature is kept constant.

More specifically, by knowing volume $V_x$ of each dosing tank 25, pressure value $P_4$ can be determined as follows:

$$P_4 = \frac{P_2 \cdot V_x}{V}$$

where, as previously specified, $P_2$ is the pressure value at which first pressurizing means 40 pressurize the gas in each dosing tank 25 before starting filling thereof with the pourable product, and V is the desired volume of pourable product to be conveyed from product tank 15 to the dosing tank 25.

The applicant has observed that temperature may vary in each dosing tank 25 as a result of the filling operation. Hence, in such a case, control of closure of each valve 28, during flow of the pourable product from product tank 15 to the respective dosing tank 25, may be also a function of the temperature detected by the respective sensor 35. In practice, the exact point in time in which each valve 28 has to be closed during filling of the respective dosing tank 25 with the pourable product may be calculated on the basis of the pressure and temperature detected by respective sensors 34, 35 and by using Boyle's gas law.

Operation of machine 1 will now be described with reference to the filling of one bottle 2, and therefore to one filling unit 12, and as of the instant in which such bottle 2 is received by support device 23 of the filling unit 12 from input star wheel 7 in order to be filled with the pourable product.

In particular (FIG. 3), the bottle 2 is centered in known manner with respect to the respective dosing tank 25 and valves 26, 27, 43 and 53 are all in their closed configurations.

Starting from this condition, valve 43 of first pressurizing means 40 is set in the open configuration (FIG. 4) and is maintained in that configuration up to the moment in which pressure of the gas in the respective dosing tank 25 reaches pressure value $P_2$. Then, the valve 43 is set in the closed configuration. During this step, the other valves 26, 28 and 52 are maintained in the closed configuration.

At this point, the respective dosing tank 25 is connected to product tank 15 to measure out volume V of pourable product prior to feeding it to the bottle 2.

In particular, the respective valve 28 is set in its open configuration (FIG. 5) to allow the pourable product to flow from product tank 15 to the dosing tank 25 under the action of the difference between pressure values $P_1$ and $P_2$.

In the meanwhile, pressure and temperature of the gas in the dosing tank 25 are measured by sensors 34, 35.

As the detected pressure of the gas in the dosing tank 25 reaches pressure value $P_4$, which, on the basis of the Boyle's gas law, is correlated with the volume V of pourable product flowed into the dosing tank 25, the valve 28 is set by control unit 22 in the closed configuration.

It should be observed that, in case of appreciable variation of temperature in the dosing tank 25 during filling of the pourable product, the point in time at which valve 28 is closed by control unit 22 is also a function of the temperature detected by sensor 35.

Once the desired volume V of pourable product has been measured up in the dosing tank 25, valve 53 of second pressurizing means 50 is set in the open configuration (FIG. 6) so as to pressurize the dosing tank 25 at pressure value P3.

The valve 26 is then also set in the open configuration so as to allow the pourable product to flow from the dosing tank 25 to the bottle 2 under the pressure difference therebetween.

Once the pourable product contained in the dosing tank 25 has been fully conveyed to the bottle 2, the valve 26 is set in the closed configuration and the bottle 2 is transferred to output star wheel 8, to be then subjected to further operations, such as capping, labelling and so on.

The advantages of machine 1 and the filling method according to the present invention will be clear from the foregoing description.

In particular, any flow of the pourable product is achieved by means of a pressure differential with limited need of using movable elements or pumps acting on the pourable product.

This leads to limited wearing parts as well as reduced risks to damage the fruit particles floating in the pourable product.

Clearly, changes may be made to machine 1 and the filling method as described and illustrated herein without, however, departing from the scope as defined in the accompanying claims.

The invention claimed is:

1. A filling machine for filling containers with a pourable product, the filling machine comprising:

a product tank containing the pourable product and a first gas maintained at a first pressure value;

at least one dosing tank containing a second gas and configured to measure out a given volume of the pourable product to be delivered to a container through a first valve;

a fluidic line connecting the at least one dosing tank to the product tank through a second valve;

a first pressurizing device configured to selectively pressurize the second gas in the at least one dosing tank to a second pressure value, that is lower than the first pressure value, when the first and second valves are both in respective closed configurations and the at least one dosing tank does not contain a substantial amount of pourable product;

a sensor configured to detect pressure of the second gas in the at least one dosing tank;

a controller configured to:

set the second valve in an open configuration after the at least one dosing tank has been pressurized to the second pressure value, in order to allow the pourable product to flow from the product tank to the at least one dosing tank under the action of the pressure difference therebetween; and set the second valve in the closed configuration as the pressure detected by the sensor in the at least one dosing tank, during flow of the pourable product into the at least one dosing tank, reaches a third pressure value corresponding to a predetermined volume of the pourable product in the dosing tank; and a second pressurizing device configured to selectively pressurize the second gas in the at least one dosing tank to a fourth pressure value, when the first valve is in an open configuration and the second valve is in the closed configuration, and wherein the pressurization of the at least one dosing tank to the fourth pressure value allows the pourable product to flow from the at least one doing tank to the container under the pressure difference therebetween.

2. The filling machine as claimed in claim 1, wherein the sensor is a first sensor, the filling machine further comprising a second sensor configured to detect temperature of the second gas in the at least one dosing tank, and wherein the controller is configured to control closure of the second valve, during flow of the pourable product from the product tank to the at least one dosing tank, based on the temperature detected by the second sensor.

3. The filling machine as claimed in claim 1, wherein the first pressurizing device includes a first pressurizing tank filled with the second gas maintained at the second pressure value and fluidically connected to the at least one dosing tank through a third valve configured to selectively move between open and closed configurations via the controller.

4. The filling machine as claimed in claim 1, wherein the second pressurizing device includes a second pressurizing tank filled with the second gas maintained at the fourth pressure value and fluidically connected to the at least one dosing tank through a fourth valve configured to selectively move between open and closed configurations via the controller.

5. The filling machine as claimed in claim 1, wherein the fourth pressure value is lower than the second pressure value.

6. The filling machine as claimed in claim 1, further comprising a plurality of dosing tanks, each connected to the product tank through a respective fluidic line.

7. A method for filling a container with a pourable product, the method comprising:

maintaining the pourable product in a product tank with a first gas at a first pressure value;

delivering a predetermined volume of the pourable product to the container through a first valve;

measuring out the predetermined volume of pourable product, via a dosing tank filled with a second gas and connected to the product tank through a second valve, prior to delivering the pourable product to the container;

pressurizing the second gas in the dosing tank at a second pressure value, that is lower than the first pressure value, with a first pressurizing tank when the first and second valves are both in respective closed configurations and the dosing tank does not contain a substantial amount of pourable product;

setting the second valve in an open configuration after the dosing tank has been pressurized to the second pressure value, to allow the pourable product to flow from the product tank to the dosing tank under the action of the pressure difference therebetween;

detecting pressure of the second gas in the dosing tank;

during flow of the pourable product from the product tank to the dosing tank, setting the second valve in the closed configuration as the pressure detected in the dosing tank reaches a third pressure value corresponding to a predetermined volume of the pourable product in the dosing tank;

pressurizing the second gas in the dosing tank to a fourth pressure value with a second pressurizing tank after the dosing tank has been filled with the predetermined volume of pourable product; and setting the first valve in an open configuration so as to allow the pourable product to flow from the dosing tank to the container under the pressure difference therebetween.

8. The method as claimed in claim 7, further comprising detecting temperature of the second gas in the dosing tank, and controlling closure of the second valve during flow of the pourable product from the product tank to the dosing tank based on the detected temperature.

9. The method as claimed in claim 7, wherein pressurizing the dosing tank to the second pressure value is performed by connecting the first pressurizing tank, filled with the second gas maintained at the second pressure value, to the dosing tank.

10. The method as claimed in claim 7, wherein pressurizing the dosing tank to the fourth pressure value is performed by connecting the second pressurizing tank, filled with the second gas maintained at the fourth pressure value, to the dosing tank.

11. The method as claimed in claim 7, wherein the fourth pressure value is lower than the second pressure value.

* * * * *